US009851736B2

(12) United States Patent
Sunley et al.

(10) Patent No.: US 9,851,736 B2
(45) Date of Patent: Dec. 26, 2017

(54) SYSTEM AND METHOD FOR CONTROLLING POWER OUTPUT OF A POWER SOURCE

(71) Applicant: Caterpillar Inc., Peoria, IL (US)

(72) Inventors: Ryan T. Sunley, Washington, IL (US); Rohit S. Tanksale, Lafayette, IN (US); William W. Fung, Peoria, IL (US); Ramakrishna Nallamalli, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 424 days.

(21) Appl. No.: 14/700,632

(22) Filed: Apr. 30, 2015

(65) Prior Publication Data

US 2016/0320784 A1 Nov. 3, 2016

(51) Int. Cl.
*G05F 1/66* (2006.01)
*F02D 29/06* (2006.01)

(52) U.S. Cl.
CPC ..... *G05F 1/66* (2013.01); *F02D 29/06* (2013.01)

(58) Field of Classification Search
CPC ..... G05F 1/66; F02D 29/06
USPC ..... 700/295
See application file for complete search history.

(56) References Cited

U.S. PATENT DOCUMENTS 4,242,592 A 12/1980 Yannone et al.
5,675,188 A 10/1997 Utamura
6,163,078 A 12/2000 Utamura
6,175,217 B1 * 1/2001 Da Ponte ..... H02J 9/066 322/19
6,931,850 B2 8/2005 Frank et al.
7,076,954 B1 7/2006 Sopko, Jr. et al.
7,542,842 B2 6/2009 Hill et al.
7,980,183 B2 7/2011 Meltser et al.
7,984,677 B2 7/2011 Meltser et al.
8,413,642 B2 4/2013 Johnson et al.
8,487,458 B2 7/2013 Steele et al.
8,573,040 B2 11/2013 Guzman et al.
8,589,002 B1 11/2013 Henry et al.
8,701,636 B2 4/2014 Jensen
8,813,885 B2 * 8/2014 Heap ..... B60W 10/06 180/65.265

(Continued)

FOREIGN PATENT DOCUMENTS

CN 203230501 10/2013
GB 456119 11/1936
JP 2008267351 11/2008

*Primary Examiner* — Christopher E Everett

(57) ABSTRACT

A control system for a power source is disclosed. The control system includes a first sensor module and a second sensor module to generate signals indicative of an ambient condition of the power source and an operating parameter of an engine of the power source, respectively. The control system further includes a controller that receives signals indicative of the ambient condition and the engine operating parameter and determines a first power output based on the ambient condition and a second power output based on the engine operating parameter. A final power output is further determined based on the first and second power outputs, which is further compared with a predetermined power output of the engine. A power conversion device that is coupled to the engine is further controlled to regulate a power output of the power source based on the comparison between the final and predetermined power outputs.

20 Claims, 4 Drawing Sheets

(56) References Cited

U.S. PATENT DOCUMENTS

| | | | | |
|---|---|---|---|---|
| 8,833,265 | B2 * | 9/2014 | Uzkan | B61C 17/12 105/61 |
| 2005/0049819 | A1 * | 3/2005 | Longnecker | F01P 7/167 702/132 |
| 2006/0284604 | A1 * | 12/2006 | Qi | H02P 9/14 322/7 |
| 2006/0287838 | A1 * | 12/2006 | Qi | H02P 9/006 702/57 |
| 2012/0109572 | A1 * | 5/2012 | Shimizu | G01K 1/165 702/131 |
| 2014/0015252 | A1 * | 1/2014 | Zhu | F03D 7/0288 290/44 |
| 2014/0062371 | A1 * | 3/2014 | Schultz | H02K 9/04 318/471 |
| 2014/0265976 | A1 * | 9/2014 | Weiss | G05D 23/1917 318/471 |

* cited by examiner

SYSTEM AND METHOD FOR CONTROLLING POWER OUTPUT OF A POWER SOURCE

TECHNICAL FIELD

The present disclosure relates to a power source, and more particularly relates to systems and methods for controlling a power output of the power source.

BACKGROUND

Power sources, such as a generator set and a hydraulic pump set are generally used for generation of electric power and irrigation of a land and crops, respectively. Such a power source includes an engine and a power conversion device, such as a generator or a hydraulic pump, to generate electric power or hydraulic power, respectively. The power sources are generally installed at a worksite to serve the purpose of the applications. The power source also typically generates a rated power output. However, a maximum power output of the power source may change based on a given ambient condition. Further, the maximum power output may be less than the rated power output. In such a case, an operator may have to visit the worksite to de-rate the power output of the power source to the maximum power output for optimal performance of the power source. However, de-rating the power output of the power source manually based on the ambient condition of the power source is a time consuming process. Further, operator skill is required for manually controlling the power output of the power source.

JP Patent Publication Number 2008-267351 (the '351 publication) discloses a method and a system for monitoring a power generating system capable of increasing the evaluation precision of the performance of an engine provided in a power generating device, and exactly predicting a failure and a deterioration status which is changed in a long time sequence. According to the '351 publication, a plurality of predetermined engine intake air temperature ranges are set and a correlation of an allowable fuel consumption rate range to a power generation output is set at each of the intake air temperature ranges. An operation data average value is calculated by extracting the operation data existing in the engine intake air temperature range and the predetermined power generation output range.

SUMMARY OF THE DISCLOSURE

In one aspect of the present disclosure, a control system for a power source having an engine and a power conversion device drivably coupled to the engine is provided. The control system includes a first sensor module configured to generate signals indicative of an ambient condition of the power source and a second sensor module configured to generate signals indicative of an operating parameter of the engine. The control system further includes a controller communicably coupled to the first sensor module and the second sensor module. The controller is configured to receive signals indicative of the ambient condition of the power source and the operating parameter of the engine. The controller is further configured to determine a first power output based on the ambient condition of the power source and a second power output based on the operating parameter of the engine. The controller is further configured to determine a final power output based on the first power output and the second power output. The final power output is a minimum value of the first power output and the second power output. The controller is further configured to compare the final power output with a predetermined power output of the engine and control the power conversion device to regulate a power output of the power source based on the comparison between the final power output and the predetermined power output.

In another aspect of the present disclosure, a control system for a generator set comprising an engine and a generator coupled to the engine is provided. The control system includes a first sensor module configured to generate signals indicative of an ambient condition of the generator set and a second sensor module configured to generate signals indicative of an operating parameter of the engine. The control system is further includes a controller communicably coupled to the first sensor module and the second sensor module. The controller is configured to receive signals indicative of the ambient condition of the generator set and the operating parameter of the engine. The controller is further configured to determine a first power output based on the ambient condition of the generator set and a second power output based on the operating parameter of the engine. The controller is further configured to determine a first de-rate value based on the first power output and a predetermined power output of the engine. The controller is further configured to determine a second de-rate value based on the second power output and the predetermined power output of the engine. The controller is further configured to determine a final de-rate value based on the first de-rate value and the second de-rate value. The final de-rate value is a minimum value of the first de-rate value and the second de-rate value. The controller is further configured to control the generator to regulate a power output of the generator set based on the final de-rate value.

In yet another aspect of the present disclosure, a method of controlling a power output of a power source is provided. The power source includes an engine and a power conversion device drivably coupled to the engine. The method includes determining an ambient condition of the power source and an operating parameter of the engine. The method further includes determining a first power output based on the ambient condition of the power source and a second power output based on the operating parameter of the engine. The method further includes determining a final power output based on the first power output and the second power output. The final power output is a minimum value of the first power output and the second power output. The method further includes comparing the final power output with a predetermined power output of the engine and controlling the power conversion device to regulate the power output of the power source based on the comparison between the final power output and the predetermined power output.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
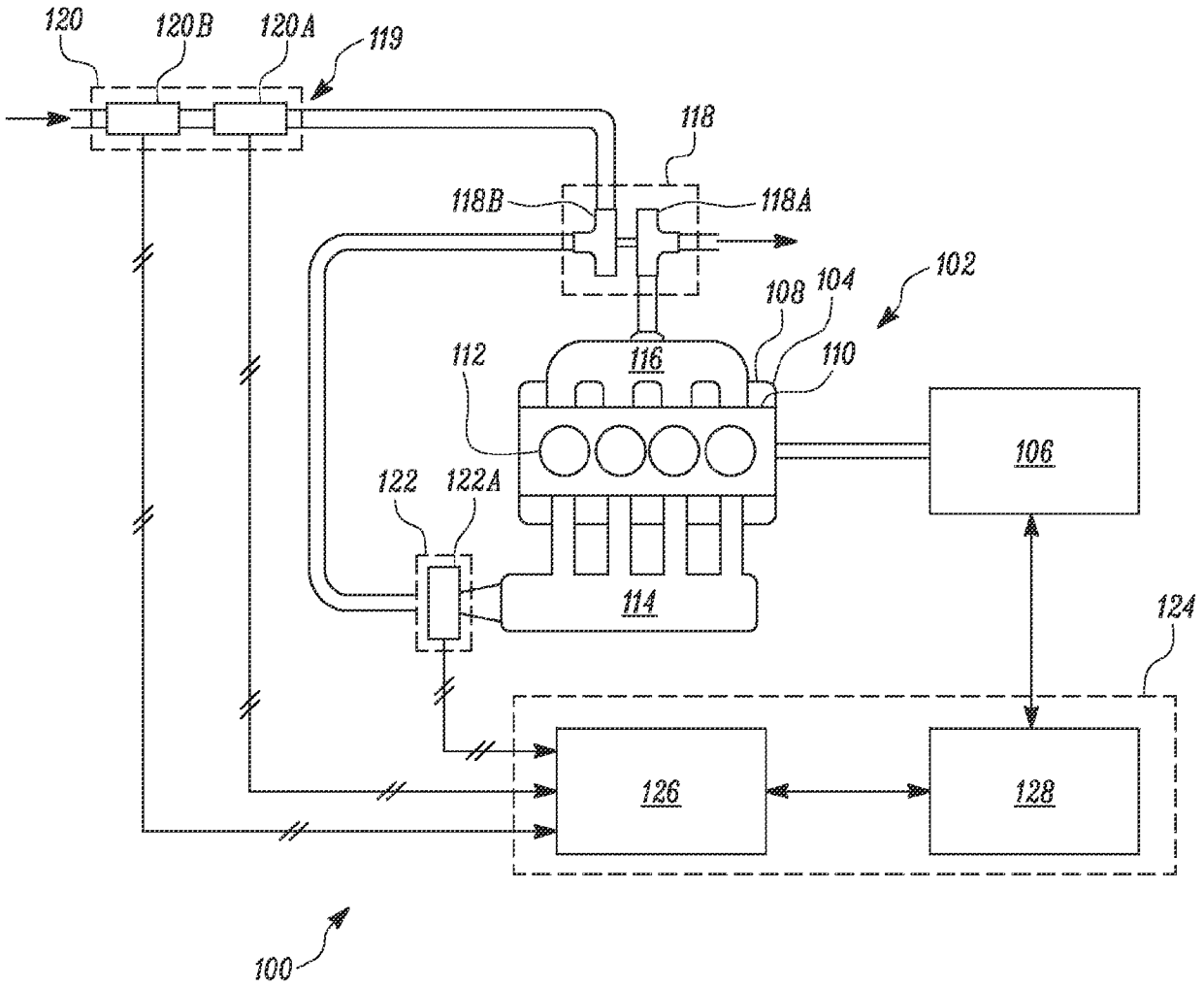
FIG. 1 is a block diagram illustrating a control system associated with a power source, according to an embodiment of the present disclosure.

FIG. 1 illustrates a control system 100 associated with a power source 102, according to an embodiment of the present disclosure. The power source 102 includes an engine 104 and a power conversion device 106 drivably coupled to the engine 104. The power conversion device 106 may be coupled to the engine 104 for receiving a power therefrom. In the illustrated embodiment, the power conversion device 106 is a generator. In various embodiments, the power conversion device 106 may be any device that may be used for converting the power received from the engine 104 into a mechanical power, a hydraulic power, a pneumatic power and/or a combination thereof. In an example, the power conversion device 106 may be a transmission system used for providing mechanical power to a machine. In another example, the power conversion device 106 may be a hydraulic pump coupled to the engine 104 for irrigation of land or crops.

The power conversion device 106 is hereinafter referred as 'the generator 106'. The generator 106 is coupled to the engine 104 for converting the power received from the engine 104 into electric power. The electric power may be used for various purposes, such as telecommunication systems and commercial outlets. The generator 106 may be an AC generator, a DC generator or any other type of electric generators known in the art.

The power source 102 including the engine 104 and the generator 106 is hereinafter referred as 'the generator set 102'. The generator set 102 may be configured to supply electric power in locations where utility power is not available or when backup electric power is required. Specifically, in applications such as telecommunications, hospitals and data processing centers, the generator set 102 may be permanently installed on a ground surface near the respective locations.

In the illustrated embodiment, the engine 104 of the generator set 102 is a gaseous engine. The engine 104 may be run by a gaseous fuel, such as LPG, CNG, hydrogen and the like. Further, the engine 104 may use the gaseous fuel as a primary fuel during operation thereof and may use gasoline or diesel as a secondary fuel during starting of the engine 104. In various alternative embodiments, the engine 104 may run on a single fuel, such as gasoline, diesel or a gaseous fuel.

The engine 104 includes a cylinder block 108 and a cylinder head 110 mounted on the cylinder block 108. The cylinder block 108 may define one or more cylinders 112. Referring to FIG. 1, a schematic inline engine is shown for illustration of the present disclosure. However, it may be contemplated that the engine 104 may be a single cylinder engine. In other embodiments, the engine 104 may include a plurality of cylinders 112 that may be arranged in various configurations, such as a rotary configuration, a V-type configuration or any other configurations known in the art. The cylinder head 110 may define one or more inlet ports and one or more outlet ports for each of the cylinders 112. The one or more inlet ports may allow air or fuel-air mixture into the cylinder 112 for combustion therein and the one or more outlet ports may discharge exhaust gas from the cylinders 112 after combustion.

The engine 104 further includes an inlet manifold 114 in communication with the one or more inlet ports of each of the cylinders 112 to receive the air or fuel-air mixture therethrough. The engine 104 further includes an exhaust manifold 116 in communication with the one or more outlet ports of each of the cylinders 112 to discharge the exhaust gas therethrough. The engine 104 further includes a turbocharger 118 coupled between the inlet manifold 114 and the exhaust manifold 116. The turbocharger 118 includes a turbine 118A in communication with the exhaust manifold 116. The turbine 118A is configured to be driven by the exhaust gas flowing from the exhaust manifold 116. The turbine 118A is further drivably coupled with a compressor 118B. The compressor 118B may be operated based on the actuation of the turbine 118A. The compressor 118B may be in fluid communication with the inlet manifold 114 to provide compressed air to the cylinders 112 of the engine 104. The compressor 118B includes an inlet 119 configured to be in communication with ambient air. The ambient air may be compressed by the compressor 118B during operation of the engine 104. The compressed ambient air is further supplied to each of the cylinders 112.

Referring to FIG. 1, the control system 100 of the generator set 102 includes a first sensor module 120 configured to generate signals indicative of an ambient condition of the generator set 102. In an embodiment, the first sensor module 120 includes a temperature sensor 120A configured to generate signals indicative of an ambient temperature 'S1'. The first sensor module 120 further includes a pressure sensor 120B configured to generate signals indicative of an ambient pressure 'S2'. In various embodiments, the first sensor module 120 may include additional sensors apart from the temperature sensor 120A and the pressure sensor 120B for generating signals indicative of various other ambient conditions, such as a relative humidity of the ambient air. In the illustrated embodiment, the temperature sensor 120A and the pressure sensor 120B are disposed adjacent to the inlet 119 of the compressor 118B. In other embodiments, the first sensor module 120 may be disposed at any location within the generator set 102 for generating signals indicative of the ambient condition of the generator set 102.

The control system 100 further includes a second sensor module 122 configured to generate signals indicative of an operating parameter of the engine 104. In an embodiment, the second sensor module 122 includes a temperature sensor 122A configured to generate signals indicative of an inlet manifold air temperature 'S3'. The inlet manifold air temperature 'S3' may further correspond to a temperature of the compressed air that is received within the inlet manifold 114 from the compressor 118B. In the illustrated embodiment, the temperature sensor 122A is disposed in the inlet manifold 114 of the engine 104. In other embodiments, the temperature sensor 122A may be disposed at a location anywhere between the inlet ports of the cylinders 112 and the compressor 118B.

In other embodiments, depending on various applications of the control system 100, the second sensor module 122 may further include additional sensors, such as pressure sensors apart from the temperature sensor 122A to generate signals indicative of various other operating parameters of the engine 104, such as an inlet manifold air pressure and a cylinder pressure. Further, the second sensor module 122 may include one or more detonation/acoustic sensors to generate signals indicative of knocking of the engine 104. The additional sensors of the second sensor module 122 may be disposed at any location in the cylinder block 108, the cylinder head 110 and the cylinder 112 of the engine 104.

Though in the illustrated embodiment, the operating parameter of the engine 104 is the inlet manifold temperature 'S3', it may be contemplated that other operating parameters of the engine 104 may also be determined. For example, a speed sensor (not shown) may be disposed in the engine 104 to generate signals indicative of a speed of the engine 104. Additional sensors may be further disposed in the engine 104 for determining any other operating parameters (for example, torque) of the engine 104.

The control system 100 further includes a controller 124 communicably coupled to the first sensor module 120 and the second sensor module 122. Further, the controller 124 is configured to be in communication with the engine 104 and the generator 106. In an example, the controller 124 may be coupled to a control panel disposed adjacent to the generator set 102. The controller 124 may be further communicated with a display device disposed in the control panel to display various input and output data related to operation of the generator set 102. Further, various control switches may be communicably coupled with the controller 124 for manually controlling operation of the generator set 102.

In the illustrated embodiment, the controller 124 includes a first control module 126 configured to be in communication with the first sensor module 120 and the second sensor module 122. The first control module 126 configured to receive signals indicative of the ambient condition of the generator set 102 and the operating parameter of the engine 104. Specifically, the first control module 126 is configured to be in communication with the first sensor module 120 to receive signals, indicative of the ambient temperature 'S1' and the ambient pressure 'S2', from the temperature sensor 120A and the pressure sensor 120B, respectively. Similarly, the first control module 126 is configured to be in communication with the second sensor module 122 to receive signals, indicative of the inlet manifold air temperature 'S3', from the temperature sensor 122A. In an example, the first control module 126 is an Engine Control Module (ECM).

In various embodiments, the first control module 126 is configured to be in communication with the engine 104 to determine various operating parameters of the engine 104 such as, the speed of the engine 104. The first control module 126 may communicate with the speed sensor to receive signals indicative of the speed of the engine 104. Additional sensors may be further communicably coupled to the first control module 126 for determining other operating parameters of the engine 104.

The controller 124 further includes a second control module 128 configured to be in communication with the first control module 126 and the generator 106 of the generator set 102. The second control module 128 is configured to monitor voltage, current and frequency of the electric power. Further, the second control module 128 is configured to control voltage and frequency of the electric power generated by the generator 106. In an example, the second control module 128 is an Electronic Modular Control Panel (EMCP).

Thus, the controller 124 may be configured to control various parameters of the generator set 102, such as the speed of the engine 104 and a voltage of the electric power generated by the generator set 102. The generator set 102 further includes a switch gear that may connect and disconnect the electric power of the generator set 102 with an external load. In an example, the external load may be a commercial outlet.

Figure 2:
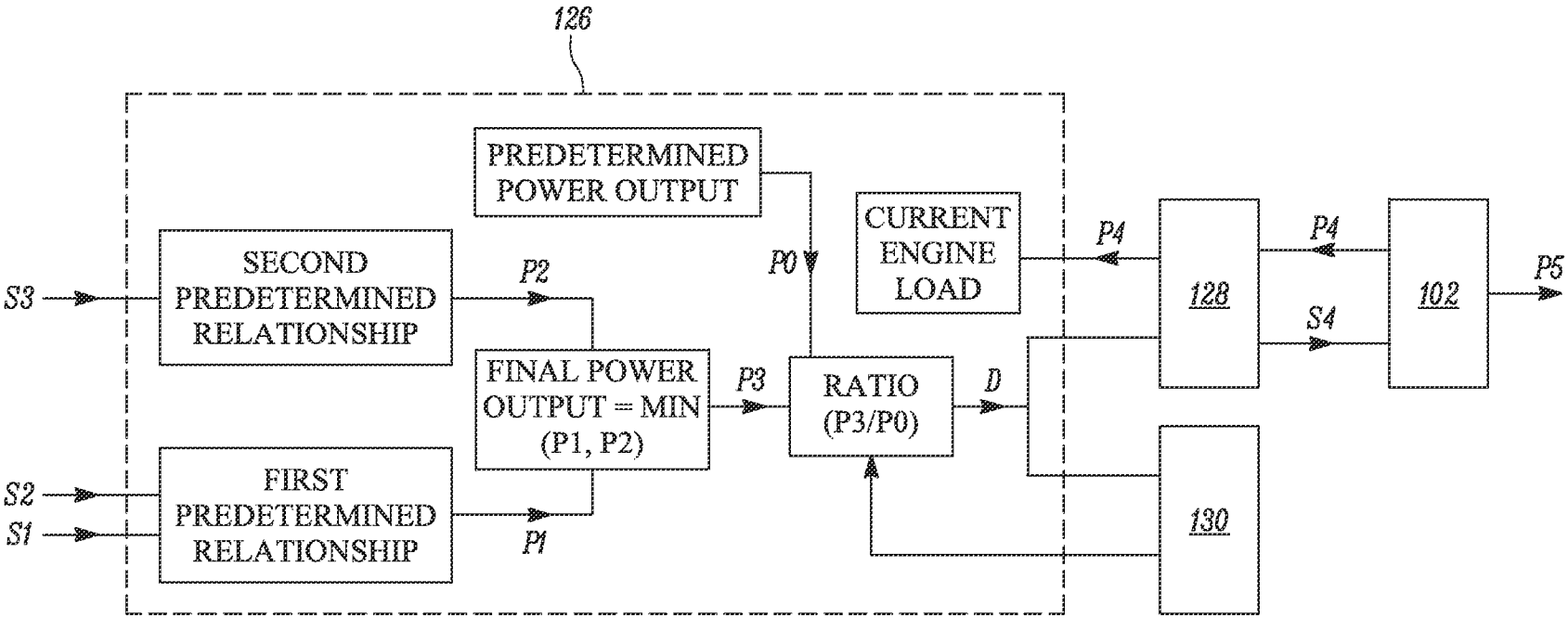
FIG. 2 is a block diagram illustrating a controller associated with the control system, according to an embodiment of the present disclosure.

FIG. 2 illustrates a block diagram of the controller 124, according to an embodiment of the present disclosure. The first control module 126 is configured to determine a first power output 'P1' based on the ambient temperature 'S1' and the ambient pressure 'S2'. Moreover, the first power output 'P1' is determined based on a first predetermined relationship between the first power output 'P1', the ambient temperature 'S1' and the ambient pressure 'S2'. The first predetermined relationship between the first power output 'P1', the ambient temperature 'S1' and the ambient pressure 'S2' may be defined based on tests or simulations conducted prior to operation of the generator set 102 at a worksite. The first predetermined relationship may be stored in a memory associated with the first control module 126. Further, the first power output 'P1' is indicative of a maximum allowable power output of the engine 104 based on the ambient temperature 'S1' and the ambient pressure 'S2'. In other embodiments, the first power output 'P1' may also be determined based on other ambient conditions of the generator set 102 apart from the ambient temperature 'S1' and the ambient pressure 'S2'. In an example, the first predetermined relationship may be a Three-Dimensional (3D) map. In another example, the first predetermined relationship may be a look-up table or a mathematical relationship.

Similarly, the first control module 126 is configured to determine a second power output 'P2' based on the inlet manifold air temperature 'S3'. Moreover, the second power output 'P2' is determined based on a second predetermined relationship between the second power output 'P2' and the inlet manifold air temperature 'S3'. The second predetermined relationship between the second power output 'P2' and the inlet manifold air temperature 'S3' may be defined based on tests or simulations conducted prior to operation of the generator set 102 at a worksite. The second predetermined relationship may be stored in the memory associated with the first control module 126. Further, the second power output 'P2' is indicative of a maximum allowable power output of the engine 104 based on the inlet manifold air temperature 'S3'. In other embodiments, the second power output 'P2' may also be determined based on other operating parameters of the engine 104 apart from the inlet manifold air temperature 'S3'. In an example, the second predetermined relationship may be a Two-Dimensional (2D) map. In another example, the second predetermined relationship may be a look-up table or a mathematical relationship.

The first control module 126 is further configured to determine a final power output 'P3' based on the first power output 'P1' and the second power output 'P2'. Specifically, the first power output 'P1' and the second power output 'P2' are compared to each other and a minimum value of the first power output 'P1' and the second power output 'P2' is determined as the final power output 'P3'.

The controller 124 is further configured to compare the final power output 'P3' with a predetermined power output 'P0' of the engine 104. In an example, the final power output 'P3' may correspond to an optimum power output of the engine 104 for optimal electric power generation from the generator set 102 based on one of the ambient condition of the generator set 102 and the operating parameter of the engine 104. The predetermined power output 'P0' may correspond to a maximum rated power output of the engine 104. The maximum rated power output of the engine 104 may be predetermined based on the ambient condition of the generator set 102 and the operating parameters of the engine 104. Further, the predetermined power output 'P0' may be stored in the memory associated with the first control module 126.

In an embodiment, the controller 124 is configured to determine a ratio between the final power output 'P3' and the predetermined power output 'P0'. The controller 124 further determines a final de-rate value 'D' based on the ratio between the final power output 'P3' and the predetermined power output 'P0'. In other embodiments, the controller 124 may be configured to output the final de-rate value 'D' based on another relationship between the final power output 'P3' and the predetermined power output 'P0' stored in the controller 124.

In another embodiment, the controller 124 may be configured to determine a first de-rate value based on the first power output 'P1' and the predetermined power output 'P0' of the engine 104. The first de-rate value may be determined based on a first relationship between the first power output 'P1' and the predetermined power output 'P0'. Similarly, the controller 124 may be further configured to determine a second de-rate value based on the second power output 'P2' and the predetermined power output 'P0' of the engine 104. The second de-rate value may be determined based on a second relationship between the second power output 'P2' and the predetermined power output 'P0'. The controller 124 is further configured to determine the final de-rate value 'D' based on the first de-rate value and the second de-rate value. The first de-rate value and the second de-rate value may be compared each other and a minimum value of the first de-rate value and the second de-rate value may be determined as the final de-rate value 'D'.

The controller 124 is further configured to control the generator 106 to regulate a power output 'P5' of the generator set 102 based on the comparison between the final power output 'P3' and the predetermined power output 'P0'. In the illustrated embodiment, the second control module 128 is configured to control the generator 106 to regulate the generator set 102 based on the final de-rate value TY. A command signal 'S4' indicative of the final de-rate value 'D' may be communicated to the generator 106 for regulating the power output 'P5' of the generator set 102. In an example, a plurality of generator sets may be coupled in parallel connection to share the external load. The power output 'P5' may be regulated based on the final de-rate value 'D' by sharing the external load in each of the generator sets 102. Further, the generator set 102 may be connected or disconnected from the external load via the switch gear based on the final de-rate value TY. In another embodiment, the power output 'P5' of the generator set 102 may be uprated if a value of the final de-rate value 'D' is greater than one.

In an embodiment, the second control module 128 may determine a current power output 'P4' of the generator set 102. The current power output 'P4' of the generator set 102 may be further communicated with the first control module 126 to determine a current load acting on the engine 104.

In an embodiment, a service kit 130 may be connected to one or more inlet-outlet ports disposed in the control panel to communicate with the controller 124. The service kit 130 may be carried by an operator to the location of the generator set 102 at predefined intervals. The service kit 130 may be further used for reading various input and output values related to operation of the engine 104 and the generator 106. The service kit 130 may be further used for resetting the first predetermined relationship and the second predetermined relationship stored in the controller 124. Thus, the final de-rate value 'D' may be optimally varied based on the ambient condition of the generator set 102 and the operating parameter of the engine 104.

In an embodiment, the controller 124 is further configured to limit a rate of change of the power output 'P5' of the generator set 102 based on a predetermined rate limit. The predetermined rate limit may be defined between an up-rate limit and a de-rate limit. The up-rate and de-rate limits may be defined to limit the rate of change of the power output 'P5' to prevent any abrupt change of the power output 'P5' in a given period of time. An unexpected change of the power output 'P5' may occur due to malfunction in the first sensor module 120, the second sensor module 122, or unexpected change in ambient condition of the generator set 102, the operating parameter of the engine 104 or the generator 106. In an example, the rate of change of the power output 'P5' may take place linearly or nonlinearly within the predetermined rate limit.

Figure 3:
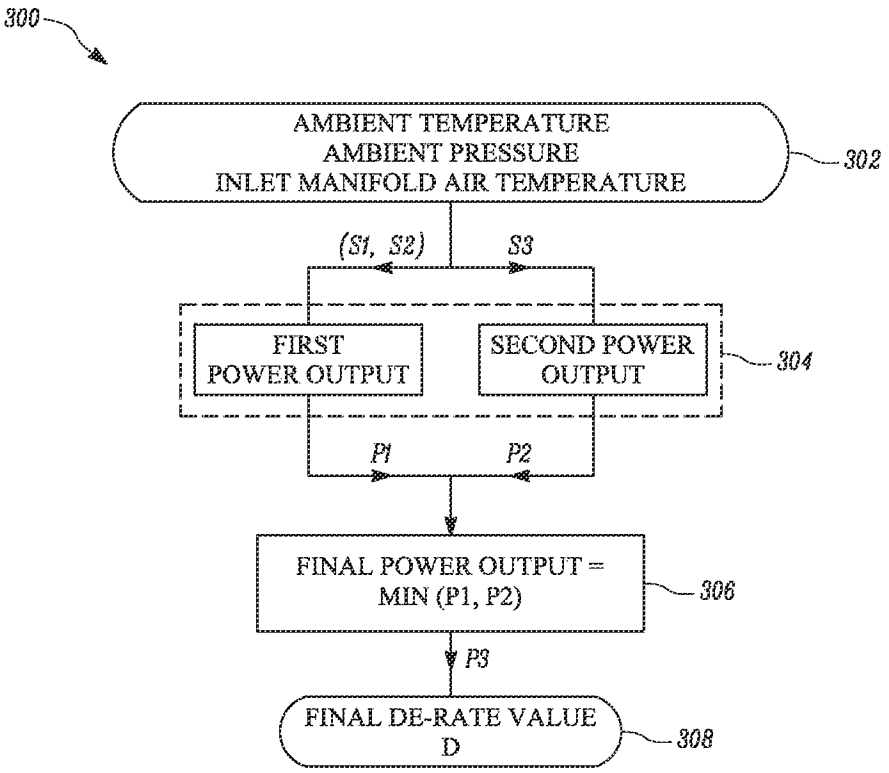
FIG. 3 is a flowchart of a method of determining a final de-rate value, according to an embodiment of the present disclosure.
Figure 4:
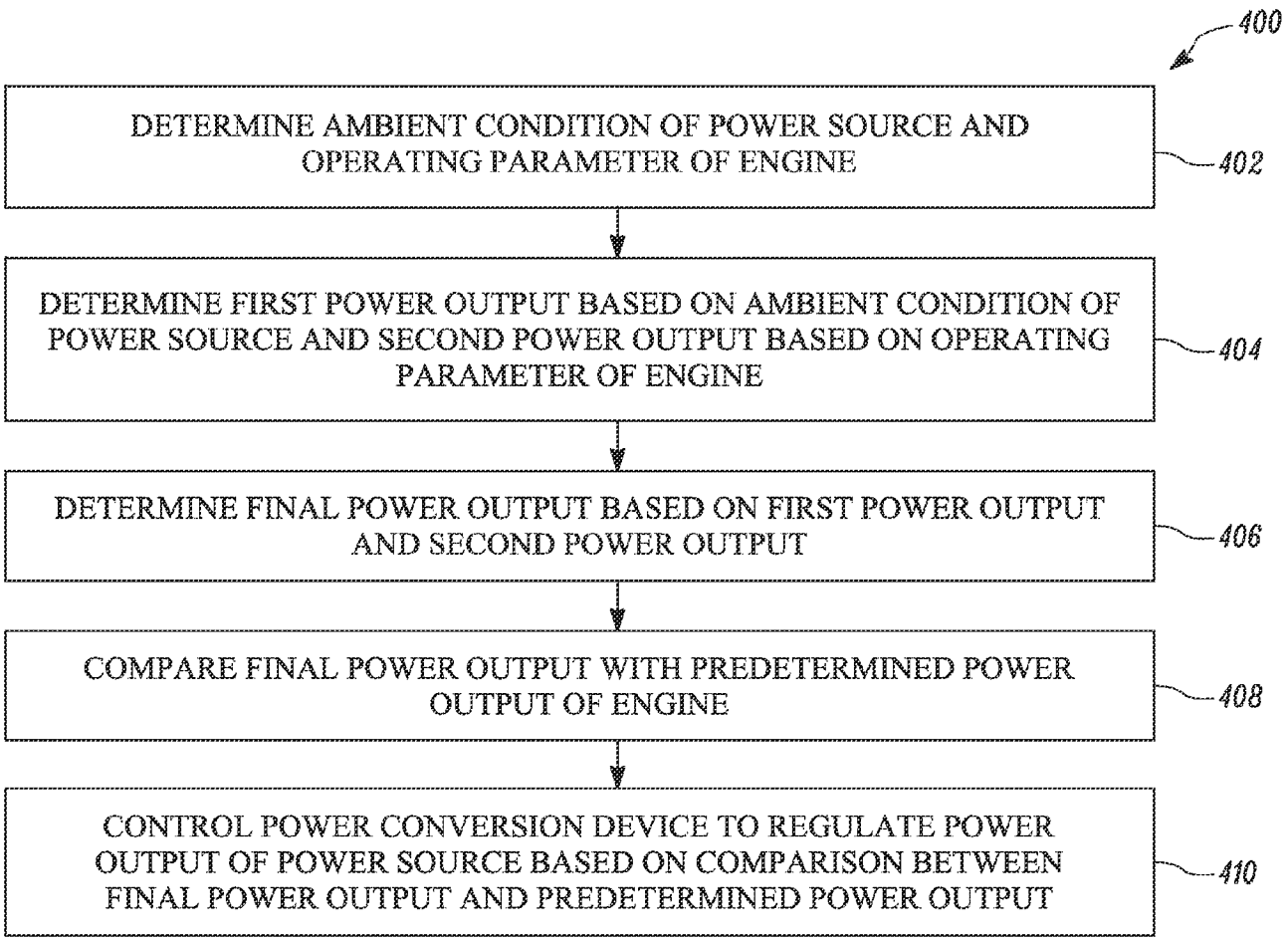
FIG. 4 is a flow chart of a method of controlling a power output of the power source, according to an embodiment of the present disclosure.

FIG. 3 illustrates a flowchart of a method 300 of determining the final de-rate value 'D', according to an embodiment of the present disclosure. At step 302, the method 300 includes determining the ambient temperature 'S1', ambient pressure 'S2' and the inlet manifold air temperature 'S3'. The first control module 126 receives signals, indicative of the ambient temperature 'S1' and the ambient pressure 'S2', generated by the temperature sensor 120A and the pressure sensor 120B, respectively, of the first sensor module 120. Similarly, the first control module 126 receives signals, indicative of the inlet manifold air temperature 'S3', generated by the temperature sensor 122A of the second sensor module 122.

At step 304, the method 300 includes determining the first power output 'P1' and the second power output 'P2'. The first control module 126 determines the first power output 'P1' based on the first predetermined relationship defined between the first power output 'P1', the ambient temperature 'S1' and the ambient pressure 'S2'. Further, the first control module 126 determines the second power output 'P2' based on the second predetermined relationship defined between the second power output 'P2' and the inlet manifold air temperature 'S3'.

At step 306, the method 300 includes determining the final power output 'P3'. The first control module 126 compares the first power output 'P1' and the second power output 'P2' and determines the minimum value of the first power output 'P1' and the second power output 'P2' as the final power output 'P3'.

In an embodiment, the first control module 126 is further configured to limit a rate of change of the final power output 'P3' determined based on the ambient condition of the generator set 102 and the operating parameter of the engine 104 based on the predetermined rate limit.

At step 308, the method 300 includes determining the final de-rate value 'D'. In an embodiment, the final power output 'P3' may be compared with the predetermined power output 'P0' of the engine 104 to determine a fraction of the final power output 'P3'. The faction of the final power output 'P3' may further correspond to the ratio between the final power output 'P3' and the predetermined power output 'P0'. In various embodiments, the fraction of the final power output 'P3' may be determined based on the predetermined power output 'P0' of the engine 104 based on a predefined mathematical relationship between the final power output 'P3' and the predetermined power output 'P0' of the engine 104. The fraction of the final power output 'P3' may be further subtracted from unity to determine the final de-rate value 'D'. The final de-rate value 'D' is further communicated with the second control module 128 to control the generator 106 and hence to regulate the power output 'P5' of the generator set 102.

INDUSTRIAL APPLICABILITY

The present disclosure relates to the control system 100 and a method 400 for controlling the power output 'P5' of the generator set 102. The controller 124 of the control system 100 is configured to determine the final de-rate value 'D' based on the ambient condition of the generator set 102 and the operating parameter of the engine 104. The final de-rate value 'D' is further communicated with the second control module 128 to regulate the power output 'P5' of the generator set 102.

At step 402, the method 400 includes determining the ambient condition of the generator set 102 and the operating parameter of the engine 104. Determining the ambient condition of the generator set 102 includes determining the ambient temperature 'S1' and the ambient pressure 'S2'. The ambient temperature 'S1' and the ambient pressure 'S2' are determined by the controller 124 based on the signals, indicative of the ambient temperature 'S1' and the ambient pressure 'S2', generated by the temperature sensor 120A and the pressure sensor 120B, respectively, of the first sensor module 120.

At step 404, the method 400 includes determining the first power output 'P1' based on the ambient condition of the generator set 102 and the second power output 'P2' based on the operating parameter of the engine 104. The ambient temperature 'S1' and the ambient pressure 'S2' are compared with the first predetermined relationship to determine the first power output 'P1'. Similarly, the inlet manifold air temperature 'S3' is compared with the second predetermined relationship to determine the second power output 'P2'.

At step 406, the method 400 includes determining the final power output 'P3' based on the first power output 'P1' and the second power output 'P2'. The controller 124 compares the first power output 'P1' and the second power output 'P2' and determines the minimum value of the first power output 'P1' and the second power output 'P2' as the final power output 'P3'.

At step 408, the method 400 includes comparing the final power output 'P3' with the predetermined power output 'P0' of the engine 104. The first control module 126 compares the final power output 'P3' with the predetermined power output 'P0' of the engine 104. In another embodiment, the second control module 128 in communication with the generator 106 may determine the current power output 'P4' of the generator set 102 and communicate the current power output 'P4' with the first control module 126. The controller 124 may determine the current load acting on the engine 104 based on the current power output 'P4' of the generator set 102.

At step 410, the method 400 includes controlling the generator 106 to regulate the power output 'P5' of the generator set 102 based on the comparison between the final power output 'P3' and the predetermined power output 'P0' of the engine 104. In an embodiment, the final de-rate value 'D' determined based on the ratio between the final power output 'P3' and the predetermined power output 'P0' is communicated to the generator 106 to regulate the power output 'P5' of the generator set 102. In another embodiment, the first de-rate value determined based on the first power output 'P1' and the second de-rate value determined based on the second power output 'P2' are compared to determine the final de-rate value 'D'.

Thus the control system 100 determines final de-rate value 'D' based on the ambient condition of the generator set and the operating parameter of the engine 104 to regulate the power output of the generator set. Hence, the operator may not be required to visit the location of the generator set 102 and manually de-rate the power output 'P5' of the generator set 102 based on the ambient condition of the generator set 102. Further, the generator set 102 may be controlled to generate optimal power output to increase life of the generator set 102.

While aspects of the present disclosure have been particularly shown and described with reference to the embodiments above, it will be understood by those skilled in the art that various additional embodiments may be contemplated by the modification of the disclosed systems and methods without departing from the spirit and scope of what is disclosed. Such embodiments should be understood to fall within the scope of the present disclosure as determined based upon the claims and any equivalents thereof.

What is claimed is:

1. A control system for a power source having an engine and a power conversion device drivably coupled to the engine, the control system comprising:

a first sensor module configured to generate signals indicative of an ambient condition of the power source;

a second sensor module configured to generate signals indicative of an operating parameter of the engine; and a controller communicably coupled to the first sensor module and the second sensor module, the controller configured to:

receive signals indicative of the ambient condition of the power source and the operating parameter of the engine;

determine a first power output based on the ambient condition of the power source and a second power output based on the operating parameter of the engine;

determine a final power output based on the first power output and the second power output, wherein the final power output is a minimum value of the first power output and the second power output;

compare the final power output with a predetermined power output of the engine; and control the power conversion device to regulate a power output of the power source based on the comparison between the final power output and the predetermined power output.

2. The control system of claim 1, wherein the first sensor module comprises:

a pressure sensor configured to generate signals indicative of an ambient pressure; and a temperature sensor configured to generate signals indicative of an ambient temperature.

3. The control system of claim 2, wherein the temperature sensor and the pressure sensor are disposed adjacent to an inlet of a compressor of the engine.

4. The control system of claim 2, wherein the controller is further configured to determine the first power output based on a first predetermined relationship between the first power output, the ambient temperature and the ambient pressure.

5. The control system of claim 1, wherein the second sensor module comprises a temperature sensor disposed in an inlet manifold of the engine, and wherein the second sensor module is configured to generate signals indicative of an inlet manifold air temperature.

6. The control system of claim 5, wherein the controller is further configured to determine the second power output based on a second predetermined relationship between the second power output and the inlet manifold air temperature.

7. The control system of claim 6, wherein the first power output is indicative of a maximum power output of the engine based on the ambient condition, and wherein the second power output is indicative of a maximum power output of the engine based on the operating parameter.

8. The control system of claim 1, wherein the controller is further configured to:

determine a ratio between the final power output and the predetermined power output;

determine a final de-rate value based on the ratio between the final power output and the predetermined power output; and control the power conversion device based on the final de-rate value to regulate the power output of the power source.

9. The control system of claim 1, wherein the controller is further configured to limit a rate of change of the power output of the power source based on a predetermined rate limit.

10. A control system for a generator set comprising an engine and a generator coupled to the engine, the control system comprising:

a first sensor module configured to generate signals indicative of an ambient condition of the generator set;

a second sensor module configured to generate signals indicative of an operating parameter of the engine; and a controller communicably coupled to the first sensor module and the second sensor module, the controller configured to:

receive signals indicative of the ambient condition of the generator set and the operating parameter of the engine;

determine a first power output based on the ambient condition of the generator set and a second power output based on the operating parameter of the engine;

determine a first de-rate value based on the first power output and a predetermined power output of the engine;

determine a second de-rate value based on the second power output and the predetermined power output of the engine;

determine a final de-rate value based on the first de-rate value and the second de-rate value, wherein the final de-rate value is a minimum value of the first de-rate value and the second de-rate value; and control the generator to regulate a power output of the generator set based on the final de-rate value.

11. The control system of claim 10, wherein the first sensor module comprises:

a pressure sensor configured to generate signals indicative of an ambient pressure; and a temperature sensor configured to generate signals indicative of an ambient temperature.

12. The control system of claim 11, wherein the temperature sensor and the pressure sensor are disposed adjacent to an inlet of a compressor of the engine.

13. The control system of claim 11, wherein the controller is further configured to determine the first power output based on a first predetermined relationship between the first power output, the ambient temperature and the ambient pressure.

14. The control system of claim 10, wherein the second sensor module comprises a temperature sensor disposed in an inlet manifold of the engine, and wherein the second sensor module is configured to generate signals indicative of an inlet manifold air temperature.

15. The control system of claim 14, wherein the controller is further configured to determine the second power output based on a second predetermined relationship between the second power output and the inlet manifold air temperature.

16. A method of controlling a power output of a power source, the power source comprises an engine and a power conversion device drivably coupled to the engine, the method comprising:

determining an ambient condition of the power source and an operating parameter of the engine;

determining a first power output based on the ambient condition of the power source and a second power output based on the operating parameter of the engine;

determining a final power output based on the first power output and the second power output, wherein the final power output is a minimum value of the first power output and the second power output;

comparing the final power output with a predetermined power output of the engine; and controlling the power conversion device to regulate the power output of the power source based on the comparison between the final power output and the predetermined power output.

17. The method of claim 16, wherein the ambient condition comprises an ambient temperature and an ambient pressure.

18. The method of claim 17 further comprising determining the first power output based on a first predetermined relationship between the first power output, the ambient temperature and the ambient pressure.

19. The method of claim 16, wherein the operating parameter of the engine comprises an inlet manifold air temperature.

20. The method of claim 16 further comprising limiting a rate of change of the power output of the power source based on a predetermined rate limit.

* * * * *